US007047959B2

(12) United States Patent
Simo et al.

(10) Patent No.: US 7,047,959 B2
(45) Date of Patent: May 23, 2006

(54) MAGNETIC ARROW REST

(75) Inventors: Miroslav A. Simo, Riverside, IL (US); Frank A. Harwath, Naperville, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/845,869

(22) Filed: May 14, 2004

(65) Prior Publication Data

US 2005/0252499 A1 Nov. 17, 2005

(51) Int. Cl.
*F41B 5/22* (2006.01)

(52) U.S. Cl. ..... 124/44.5

(58) Field of Classification Search ..... 124/24.1, 124/44.5, 86, 91, 44.6, 92
See application file for complete search history.

(56) References Cited

U.S. PATENT DOCUMENTS

| | | | | |
|---|---|---|---|---|
| 2,786,461 A | | 3/1957 | Pelsue, Jr. | |
| 3,670,711 A | | 6/1972 | Firestone | |
| 4,282,850 A | * | 8/1981 | Warnicke | 124/24.1 |
| 4,343,286 A | | 8/1982 | Thacker | |
| 4,473,058 A | | 9/1984 | Terry | |
| 4,548,189 A | | 10/1985 | Pietraszek et al. | |
| 4,741,320 A | | 5/1988 | Wiard | |
| 4,860,719 A | | 8/1989 | Scheiterlein | |
| 4,917,072 A | * | 4/1990 | Chang | 124/41.1 |
| 5,025,773 A | * | 6/1991 | Hintze et al. | 124/44.5 |
| 5,042,450 A | * | 8/1991 | Jacobson | 124/44.5 |
| 5,253,633 A | * | 10/1993 | Sisko | 124/44.5 |
| 5,365,912 A | * | 11/1994 | Pittman | 124/44.5 |
| 5,456,242 A | * | 10/1995 | Ruholl | 124/44.5 |
| 5,460,153 A | * | 10/1995 | Huntt | 124/44.5 |
| 5,490,492 A | * | 2/1996 | Savage | 124/44.5 |
| 5,503,136 A | | 4/1996 | Tone | |
| 5,520,163 A | | 5/1996 | Hurd | |
| 5,537,986 A | * | 7/1996 | Summers | 124/91 |
| 5,769,065 A | | 6/1998 | Hurd | |
| 6,202,635 B1 | * | 3/2001 | Evans | 124/44.5 |
| 6,343,600 B1 | * | 2/2002 | Steinman | 124/91 |
| 6,688,296 B1 | * | 2/2004 | Greywall | 124/44.5 |
| 6,920,870 B1 | * | 7/2005 | Minica et al. | 124/44.5 |

FOREIGN PATENT DOCUMENTS

DE 3405463 A1 8/1985

* cited by examiner

*Primary Examiner*—John A. Ricci
(74) *Attorney, Agent, or Firm*—Pauley Peterson & Erickson

(57) ABSTRACT

An arrow rest including a magnetic ring mounted with respect to an archery bow. The magnetic ring includes an inner surface that defines an arrow shaft passage and an outer surface. The magnetic ring produces a first magnetic field about the arrow shaft passage. The magnetic ring forms an opening between the inner surface and the outer surface, and a shaft of an archery arrow is passable through the opening to position the arrow shaft within the arrow shaft passage. The archery arrow is movable between a loading position and a drawn position. In the drawn position, the first magnetic field interacts with a second magnetic field produced by a second magnet mounted at a tip portion of the archery arrow to suspend a portion of the arrow shaft within the arrow shaft passage.

8 Claims, 21 Drawing Sheets

MAGNETIC ARROW REST

BACKGROUND OF THE INVENTION

1. Field of the Invention

This invention relates to an arrow rest, and more particularly, to a magnetic arrow rest for suspending a portion of an archery arrow shaft, in a drawn position, within an arrow shaft passage formed by a magnetic ring of the magnetic arrow rest.

2. Discussion of Related Art

Conventional arrow rests are attached or mounted to an archery bow to support or position an archery arrow in a drawn position. Many conventional arrow rests include mechanical components or elements that serve to maintain the archery arrow in a steady, drawn position prior to the archer releasing the archery arrow from the archery bow. As the archery arrow is released from the drawn position, the mechanical components or elements may undesirably interfere with and/or contact a portion of the archery arrow, such as the fletching or vanes attached at an aft end portion of the archery arrow, and adversely affect the accuracy of the archery arrow flight pattern and/or the desired trajectory of the archery arrow.

In order to prevent undesirable interference and/or contact as the archery arrow is released from the archery bow, some conventional mechanical arrow rests include support arms that rotate or move as the archery arrow is released from the arrow rest. However, such movement is not always successful in preventing the archery arrow fletching from contacting the arrow rest prior to flight and, thus, may not be effective in limiting or preventing undesirable interference and/or contact between the released archery arrow and the arrow rest.

There is an apparent need for an arrow rest that properly supports an archery arrow in a drawn position, and does not interfere with and/or contact the archery arrow, for example the archery arrow fletching or vanes, as the archery arrow is released from the archery bow.

SUMMARY OF THE INVENTION

It is one object of this invention to provide an improved arrow rest.

It is another object of this invention to provide an arrow rest without mechanical components that interfere with and/or contact an archery arrow as the archery arrow is released from the archery bow.

The above and other objects of this invention are accomplished with a magnetic arrow rest and a magnetic arrow rest assembly. The arrow rest includes a magnetic ring that is mountable with respect to an archery bow. In one preferred embodiment of this invention, the magnetic ring is integrated with the archery bow. The magnetic ring forms an arrow shaft passage and produces a first magnetic field about the arrow shaft passage. A second magnet is mountable to a tip portion of an archery arrow having a shaft positionable within the arrow shaft passage. Preferably, the second magnet is insertable within the arrow shaft at the archery arrow tip portion. The second magnet produces a second magnetic field, which interacts with the first magnetic field to suspend a portion of the arrow shaft within the arrow shaft passage, with the archery arrow in a drawn position. In the drawn position, the arrow shaft is preferably centered within the first magnetic field. The magnetic ring forms or includes an opening, and the arrow shaft is passable through the opening to position the arrow shaft within the arrow shaft passage.

The invention further comprehends an arrow rest that includes a magnetic ring mounted with respect to an archery bow. Preferably, the magnetic ring is mounted with respect to a riser shelf of the archery bow. The magnetic ring includes an inner surface that defines an arrow shaft passage and an opposing outer surface. The magnetic ring produces a first magnetic field about the arrow shaft passage. The magnetic ring forms an opening between the inner surface and the outer surface that communicates with the arrow shaft passage, for receiving a shaft of an archery arrow. The arrow shaft is positionable within the arrow shaft passage and the archery arrow is movable through the arrow shaft passage between a loading position and a drawn position. In the drawn position, the first magnetic field interacts with a second magnetic field produced by a magnet mounted at a tip portion of the archery arrow to suspend a portion of the arrow shaft within the arrow shaft passage.

The invention still further comprehends an arrow rest assembly preferably including an attachment bracket secured to an archery bow and with respect to a riser shelf of the archery bow. A magnetic ring is mounted to the attachment bracket. The magnetic ring includes an inner surface defining an arrow shaft passage and an opposing outer surface. The magnetic ring produces a first magnetic field about the arrow shaft passage. The magnetic ring forms an opening between the inner surface and the outer surface that is in communication with the arrow shaft passage, for receiving a shaft of an archery arrow. The arrow shaft is positionable within the arrow shaft passage and the archery arrow is movable through the arrow shaft passage between a loading position and a drawn position. A second magnet mountable at a tip portion of the archery arrow produces a second magnetic field, wherein, in the drawn position, the first magnetic field interacts with the second magnetic field to suspend a portion of the arrow shaft within the arrow shaft passage.

Other objects and advantages of the invention are apparent to those skilled in the art, in view of the following detailed description taken in conjunction with the appended claims and drawings.

DETAILED DESCRIPTION OF PREFERRED EMBODIMENTS

Figure 1:
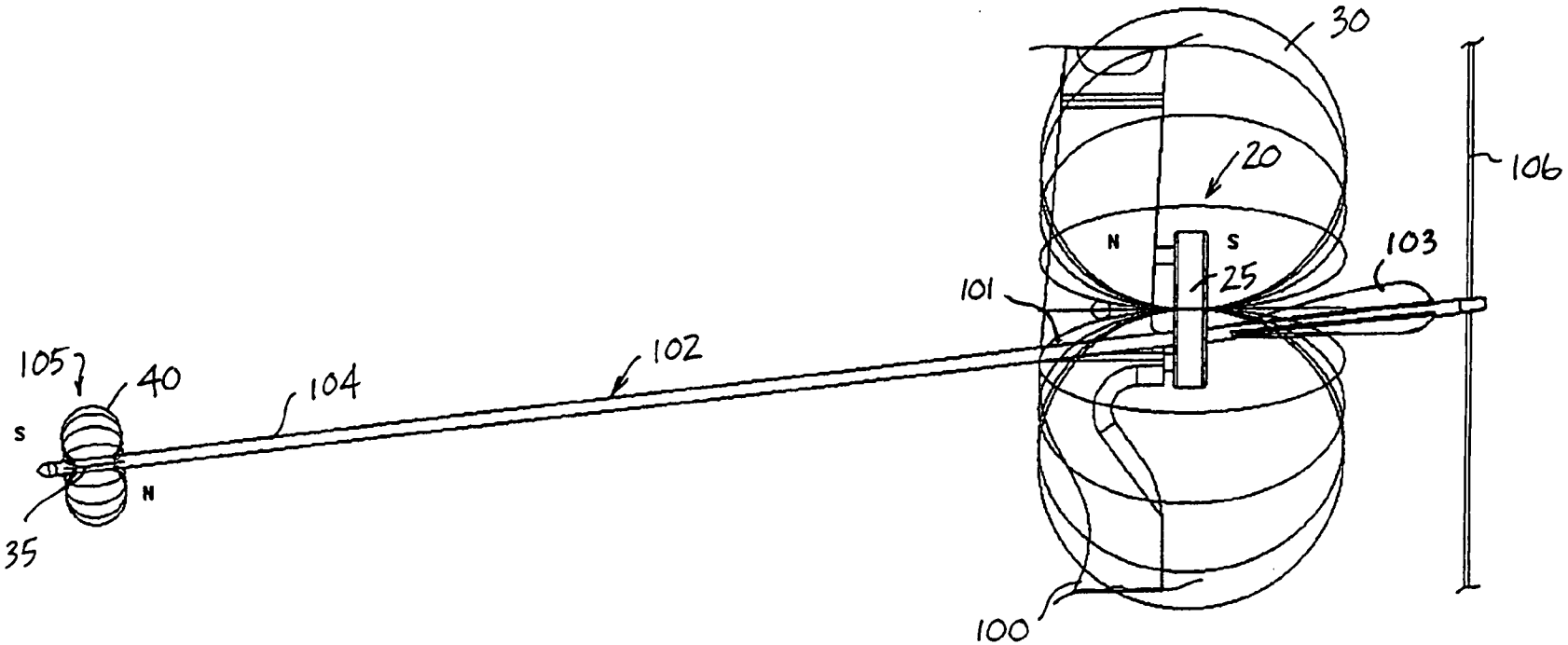
FIG. 1 is a side view of an archery arrow positioned in a rest or loading position within a magnetic arrow rest, according to one preferred embodiment of this invention.

The present invention provides an arrow rest 20 including a magnetic ring 25 mountable or connectable with respect to an archery bow 100, as shown in FIGS. 1–11. Preferably, magnetic ring 25 is mounted with respect to a riser portion or riser shelf 101 of the archery bow. Magnetic ring 25 forms or includes an inner surface 26 that forms or defines an arrow shaft passage 28, as shown in FIGS. 4–11, which is positionable with respect to the riser portion 101. Magnetic ring 25 also includes an outer surface 29 about a periphery of magnetic ring 25, which generally opposes inner surface 26. Magnetic ring 25 can comprise any suitable magnetic material, such as a permanent magnetic material or an electromagnetic material. In one preferred embodiment of this invention, magnetic ring 25 is made of a Neodymium Iron Boron (NdFeB) permanent magnet. As shown in FIGS. 1–6, magnetic ring 25 produces or provides a first magnetic field 30 about arrow shaft passage 28.

Preferably, but not necessarily, arrow shaft passage 28 has a generally cylindrical configuration or shape. It is apparent to those skilled in the art and guided by the teachings herein provided that arrow shaft passage 28 can have any suitable size and/or shape provided that an archery arrow 102 is able to freely move through arrow shaft passage 28 without any undesired interference from and/or contact with inner surface 26 forming arrow shaft passage 28, for example as archery fletching or vanes 103 (attached to an aft end portion of the archery arrow 102) move through arrow shaft passage 28. Further, the size and/or shape of arrow shaft passage 28 may be limited by the magnetic interactions required for proper performance or operation of arrow rest 20, as discussed in greater detail below.

Figure 7:
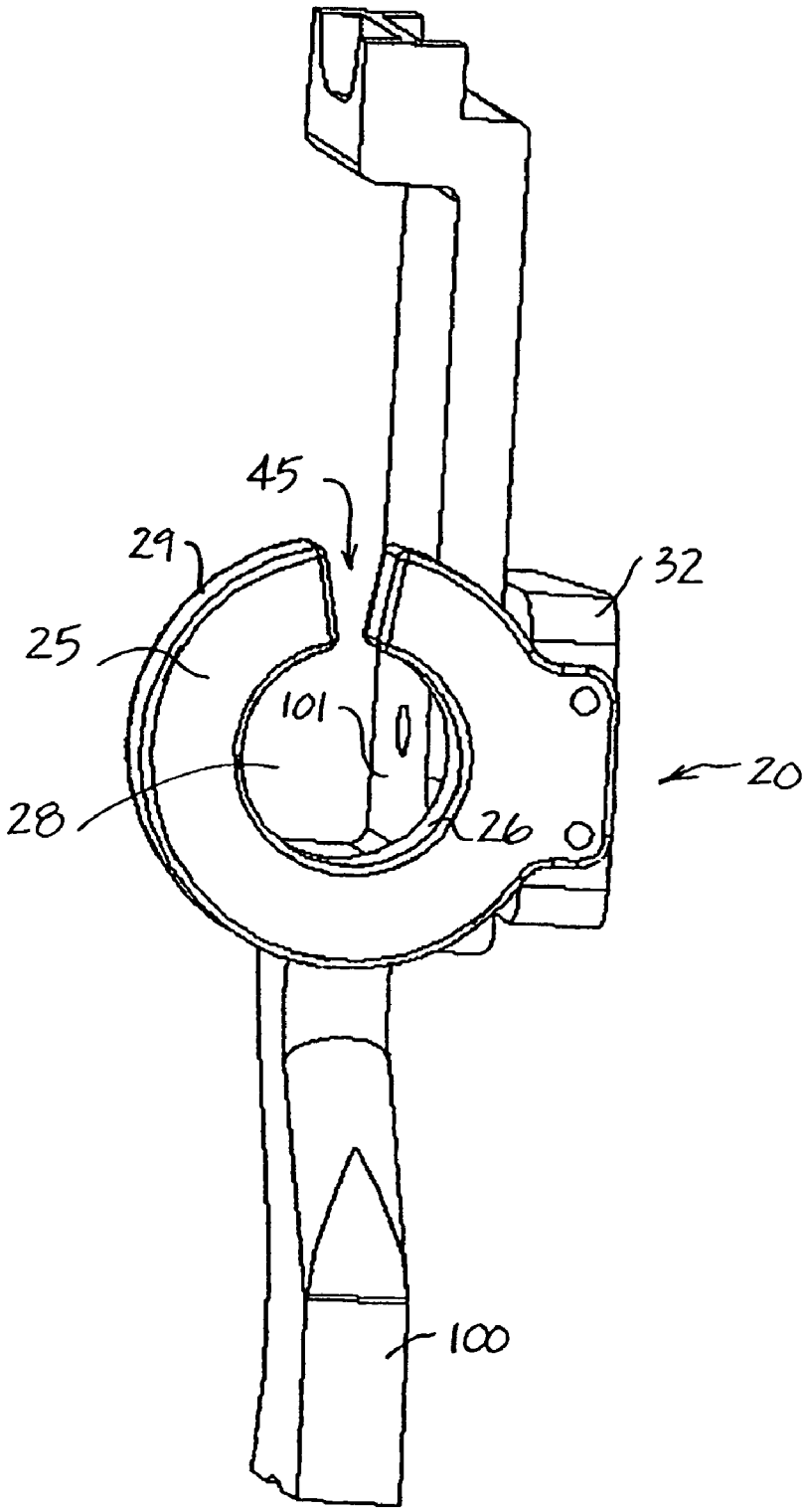
FIG. 7 is a partial front perspective view of a magnetic arrow rest mounted to an archery bow, according to one preferred embodiment of this invention.
Figure 8:
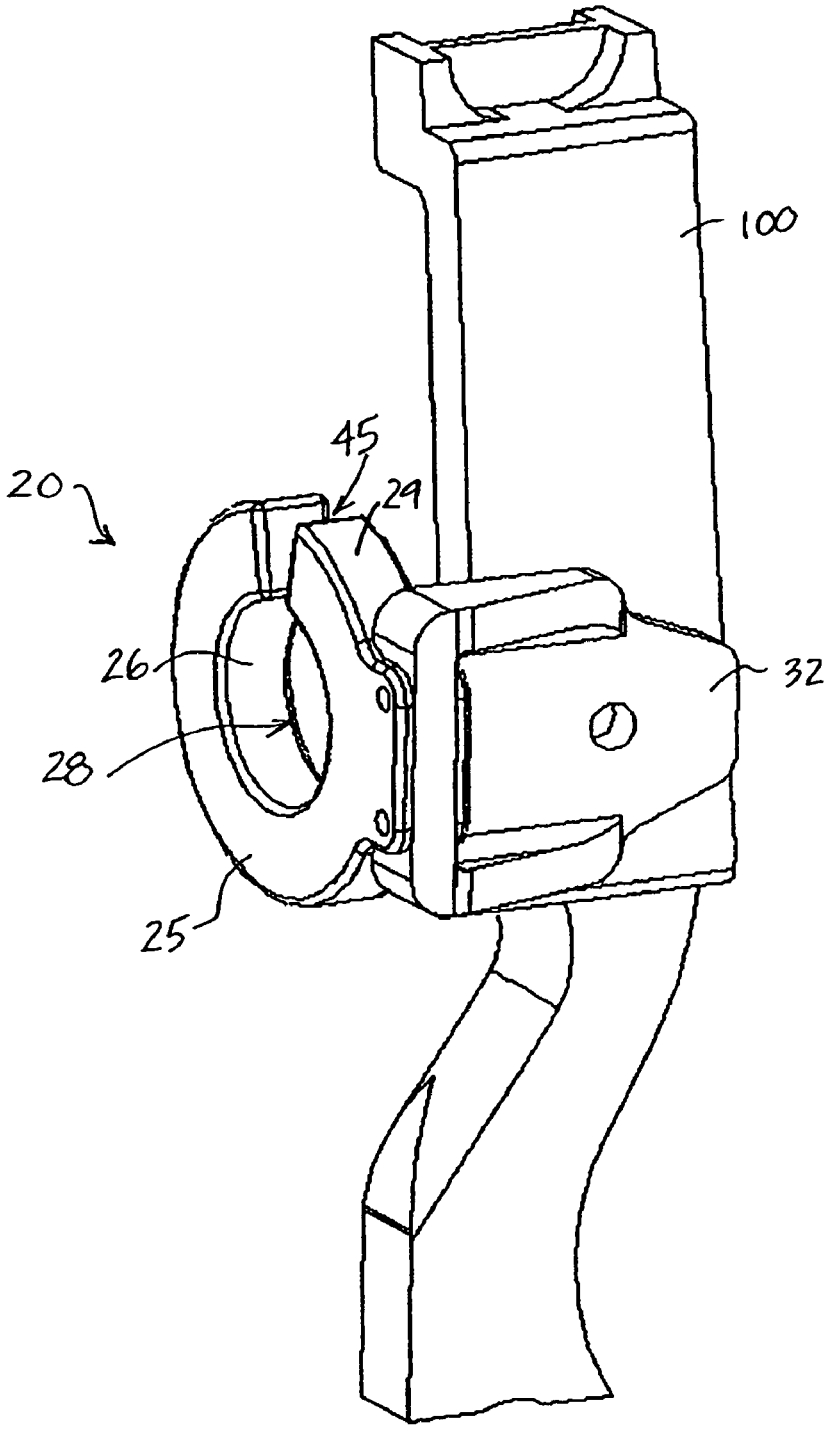
FIG. 8 is a partial side perspective view of a magnetic arrow rest mounted to an archery bow, according to one preferred embodiment of this invention.

Referring to FIGS. 7 and 8, magnetic ring 25 can be removably or permanently mounted to an attachment bracket 32. Preferably, attachment bracket 32 is mounted or secured to the archery bow 100 at the bow riser portion 101.

In one preferred embodiment of this invention, a second magnet 35, for example a magnetic insert, is mountable on, to or within the archery arrow 102. Preferably, second magnet 35 is insertable within a shaft 104 of the archery arrow 102 at a tip portion 105 of the archery arrow 102. Second magnet 35 produces or provides a second magnetic field 40 about tip portion 105, as shown in FIGS. 1–6. Preferably, second magnet 35 includes the same or similar material as magnetic ring 25. However, second magnet 35 can be made of any suitable magnetic material, such as a permanent magnetic material or an electromagnetic material. In one preferred embodiment of this invention, second magnet 35 is made of a Neodymium Iron Boron (NdFeB) permanent magnet.

Figure 3:
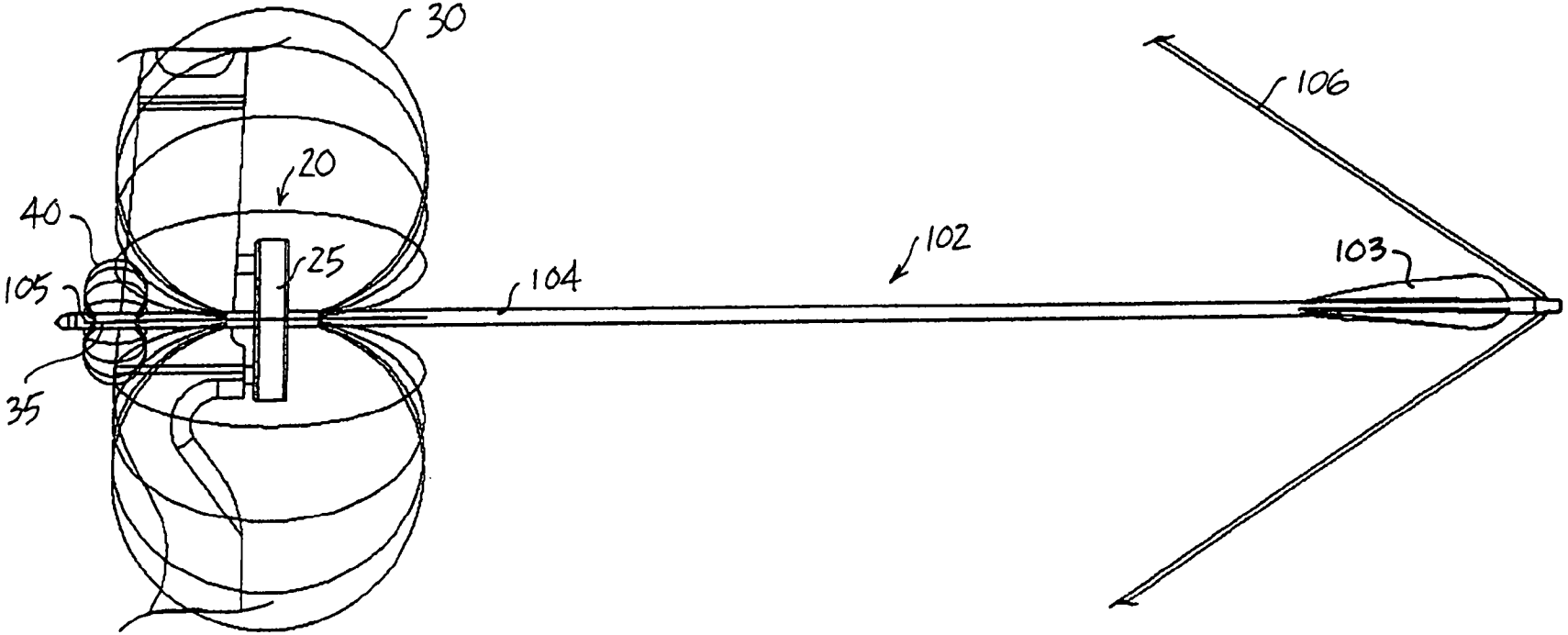
FIG. 3 is a side view of an archery arrow positioned in a final or drawn position within a magnetic arrow rest, according to one preferred embodiment of this invention.
Figure 4:
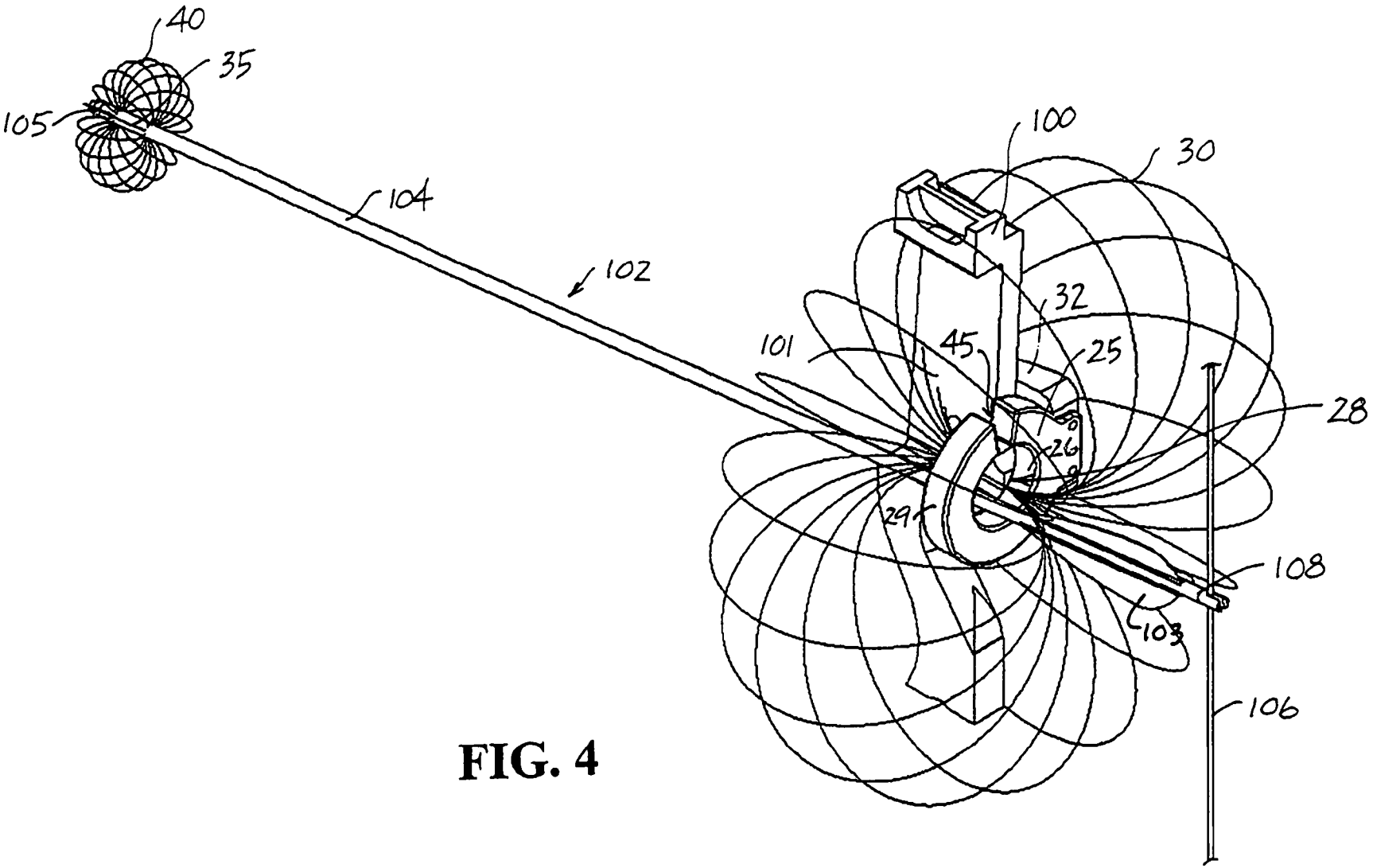
FIG. 4 is a perspective view of an archery arrow positioned in a rest or loading position within a magnetic arrow rest, according to one preferred embodiment of this invention.
Figure 5:
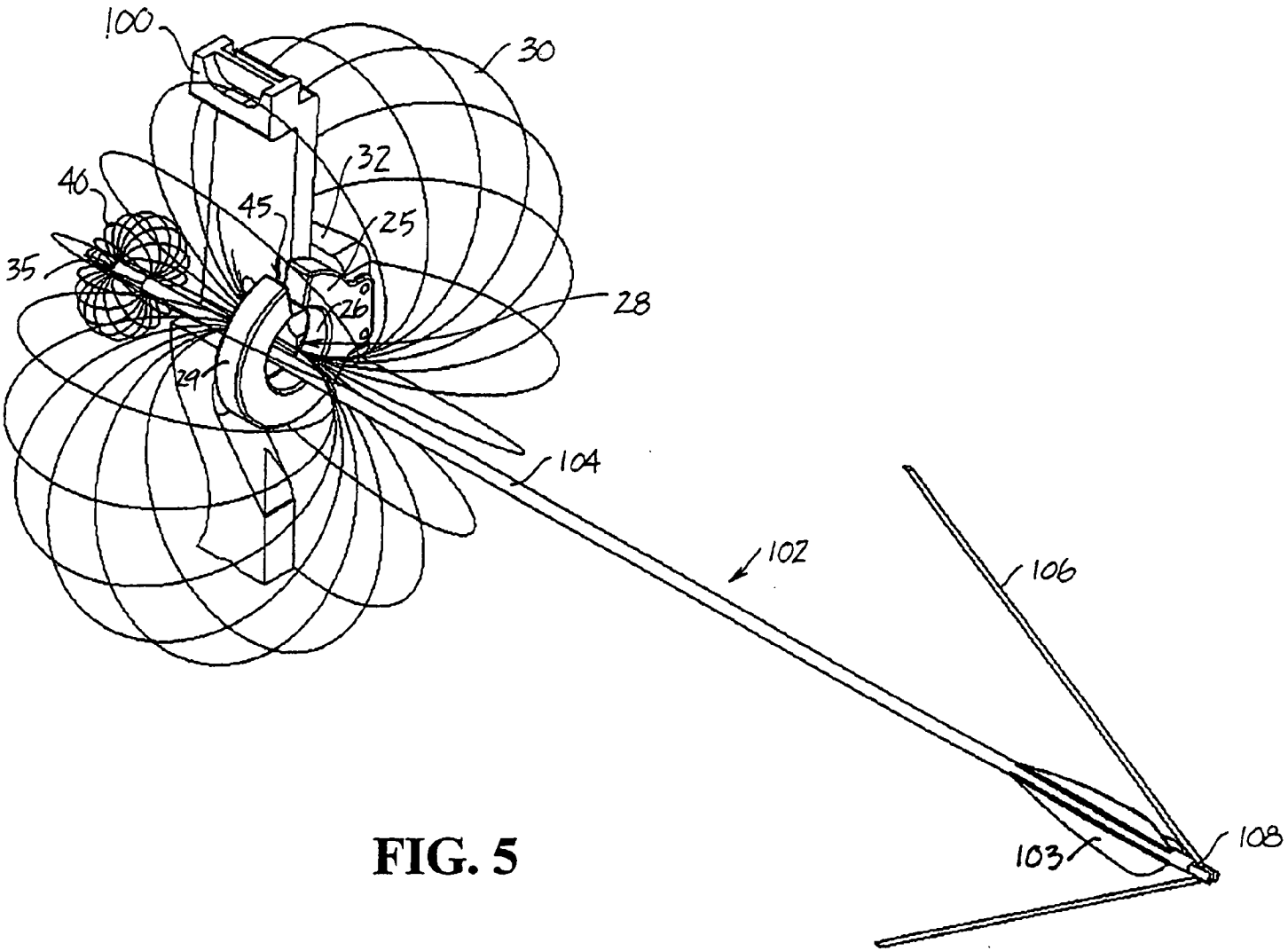
FIG. 5 is a perspective view of an archery arrow positioned in a partially drawn position within a magnetic arrow rest, according to one preferred embodiment of this invention.
Figure 6:
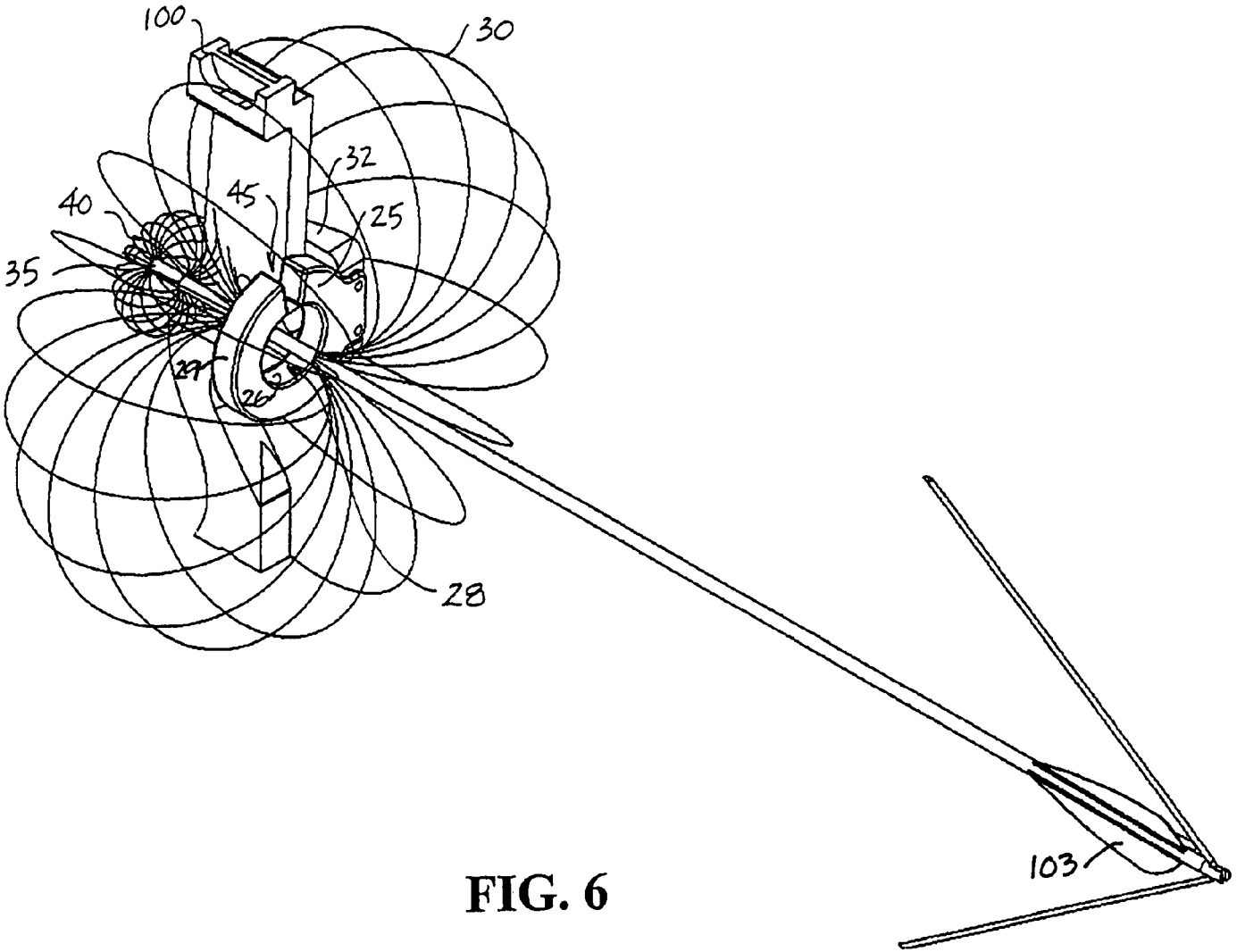
FIG. 6 is a perspective view of an archery arrow positioned in a final or drawn position within a magnetic arrow rest, according to one preferred embodiment of this invention.

With the arrow shaft 104 positioned within arrow shaft passage 28, the archery arrow 102 can be drawn by pulling bow string 106 from a rest or loading position, as shown in FIGS. 1 and 4, to a final or drawn position, as shown in FIGS. 3 and 6. Referring further to FIGS. 3 and 6, in the drawn position, first magnetic field 30 interacts with second magnetic field 40 produced by second magnet 35 mounted at the tip portion 105 of the archery arrow 102, to suspended a portion of the arrow shaft 104 within arrow shaft passage 28. Preferably, in the drawn position, the arrow shaft 104 is centered within first magnetic field 40, as shown in FIGS. 3 and 6.

The interaction between first magnetic field 30 and second magnetic field 40 can include either a magnetic attraction or magnetic repulsion, depending upon the alignment of the poles of magnetic ring 35 with respect to the poles of second magnet 35. As shown in FIG. 1, a North (N) pole of magnetic ring 25 is positioned or aligned with respect to a North (N) pole of second magnet 35 to produce a magnetic repulsion that suspends a portion of the arrow shaft 104 within arrow shaft passage 28.

Figure 9:
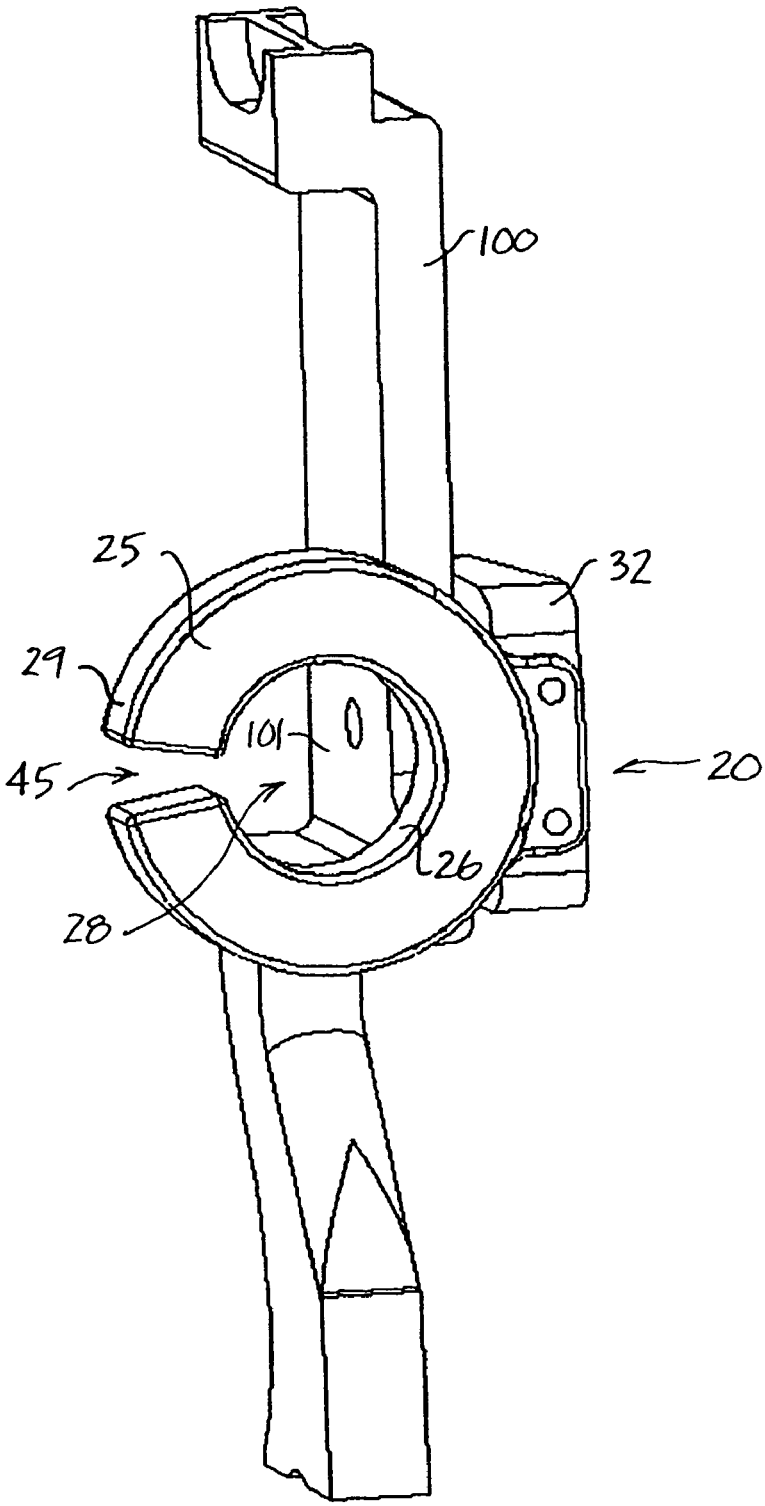
FIG. 9 is a partial front perspective view of a magnetic arrow rest mounted to an archery bow, according to one preferred embodiment of this invention.

In one preferred embodiment of this invention, magnetic ring 25 includes or forms an opening 45 at a periphery of magnetic ring 35, as shown in FIGS. 4–14, for receiving the arrow shaft 104. Opening 45 extends between inner surface 26 and outer surface 29 of magnetic ring 25 and communicates with arrow shaft passage 28 to allow the arrow shaft 104 to be moved or passed through opening 45 and positioned within arrow shaft passage 28. Opening 45 has any suitable size and/or shape that allows the arrow shaft 104 to move through opening 45. Further, opening 45 can be positioned at any suitable location on magnetic ring 25. For example, opening 45 can be located at a generally vertical or upright position on magnetic ring 25, as shown in FIG. 7, or opening 45 can be located at a general side position on magnetic ring 25, as shown in FIG. 9. Loading the archery arrow 102 through opening 45 avoids having to load the archery arrow 102 within arrow rest 20 by inserting the archery arrow 102 through arrow shaft passage 28, which can result in undesirable contact and/or magnetic interaction between second magnet 35 on the arrow tip portion 105 and magnetic ring 25. Such undesirable contact and/or magnetic interaction produces undesirable noise and interference as the archery arrow 102 is nocked and moved with respect to arrow rest 20 to the rest or loading position.

By providing opening 45 on magnetic ring 25, the archery arrow 102 can be easily positioned within arrow rest 20. For example, second magnet 35 can be initially positioned away from magnetic ring 25, to avoid or minimize magnetic interaction between second magnet 35 and magnetic ring 25. Thus, the archery arrow 102 can be easily nocked without any magnetic interaction and/or interference. Preferably, the arrow shaft 104 is positioned within arrow shaft passage 28 at the aft end portion of the arrow shaft 104, for example frontal to the fletching 103, to avoid or minimize the magnetic interaction and/or interference. With the archery arrow loaded within arrow shaft passage 28, the archery arrow 102 is movable through arrow shaft passage 28 and with respect to arrow rest 20 between the loading position, as shown in FIGS. 1 and 4, and the drawn position, as shown in FIGS. 3 and 6.

In one preferred embodiment of this invention, at least a portion of magnetic ring 25 can be shaped to compensate for any distortion of first magnetic field 30 as a result of forming opening 45 on magnetic ring 25. A distortion of first magnetic field 30 may result in a change or variation in arrow shaft placement, at the drawn position for example, within arrow shaft passage 28. The misplacement of the arrow shaft 104 can result in inadequate fletching clearance and/or an archer's perception that the archery arrow 102 is not properly centered on a target.

Figure 10:
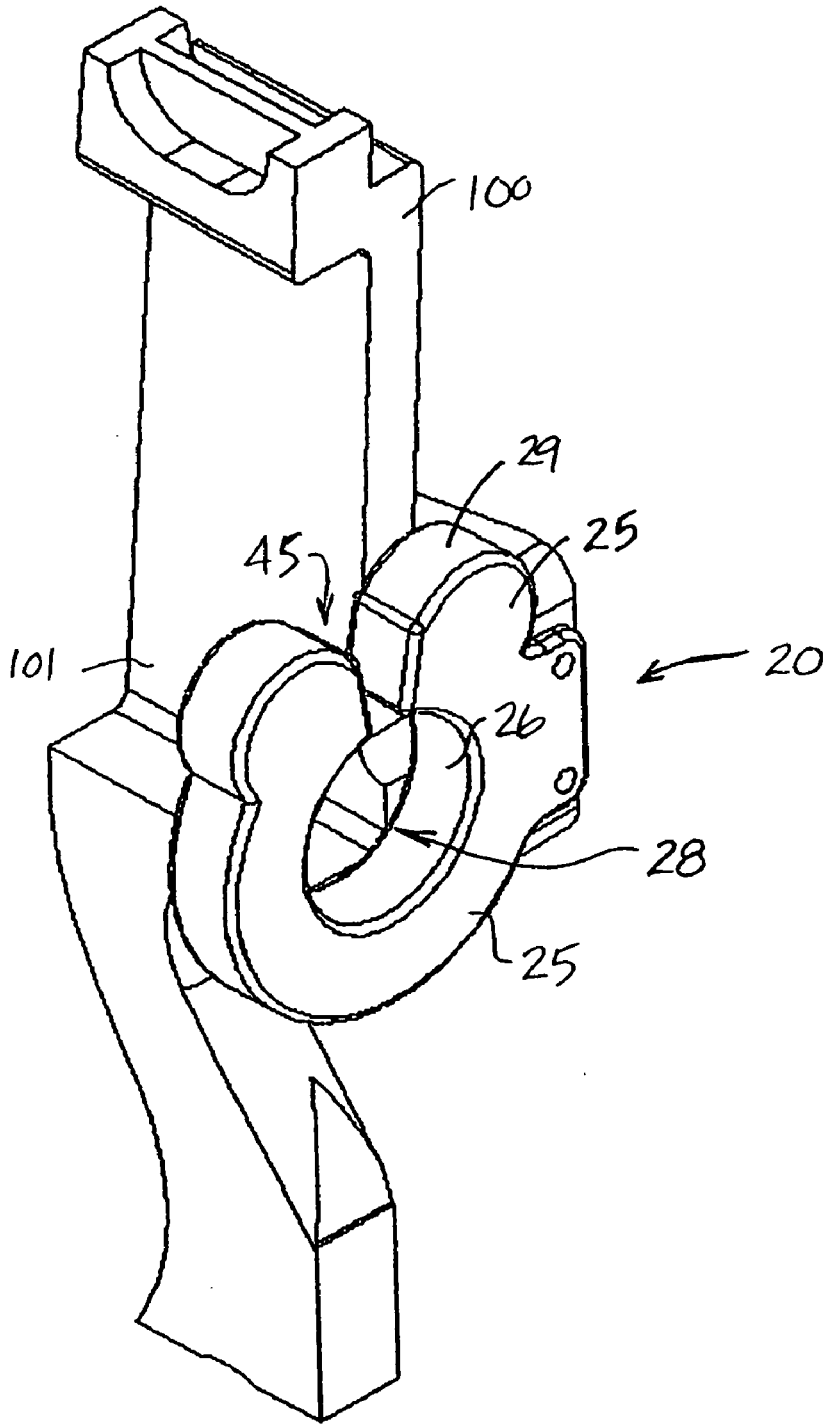
FIG. 10 is a partial side perspective view of an asymmetric magnetic arrow rest mounted to an archery bow, according to one preferred embodiment of this invention.

As shown in FIG. 10, at least a portion of a periphery of magnetic ring 25 can be non-cylindrical and/or asymmetric, wherein magnetic ring 25 is shaped to compensate for the formation of opening 45. Additional magnetic ring material can be included near or at opening 45 to increase a local intensity of first magnetic field 30. It is apparent to those skilled in the art and guided by the teachings herein provided that magnetic ring 25 can be molded to have any suitable shape. Therefore, magnetic field 30 can be shaped or configured as desired by the archer. Further, additional magnetic ring material maybe required or desired to provide a stronger first magnetic field 30 to stabilize longer and/or heavier archery arrows.

Figure 11:
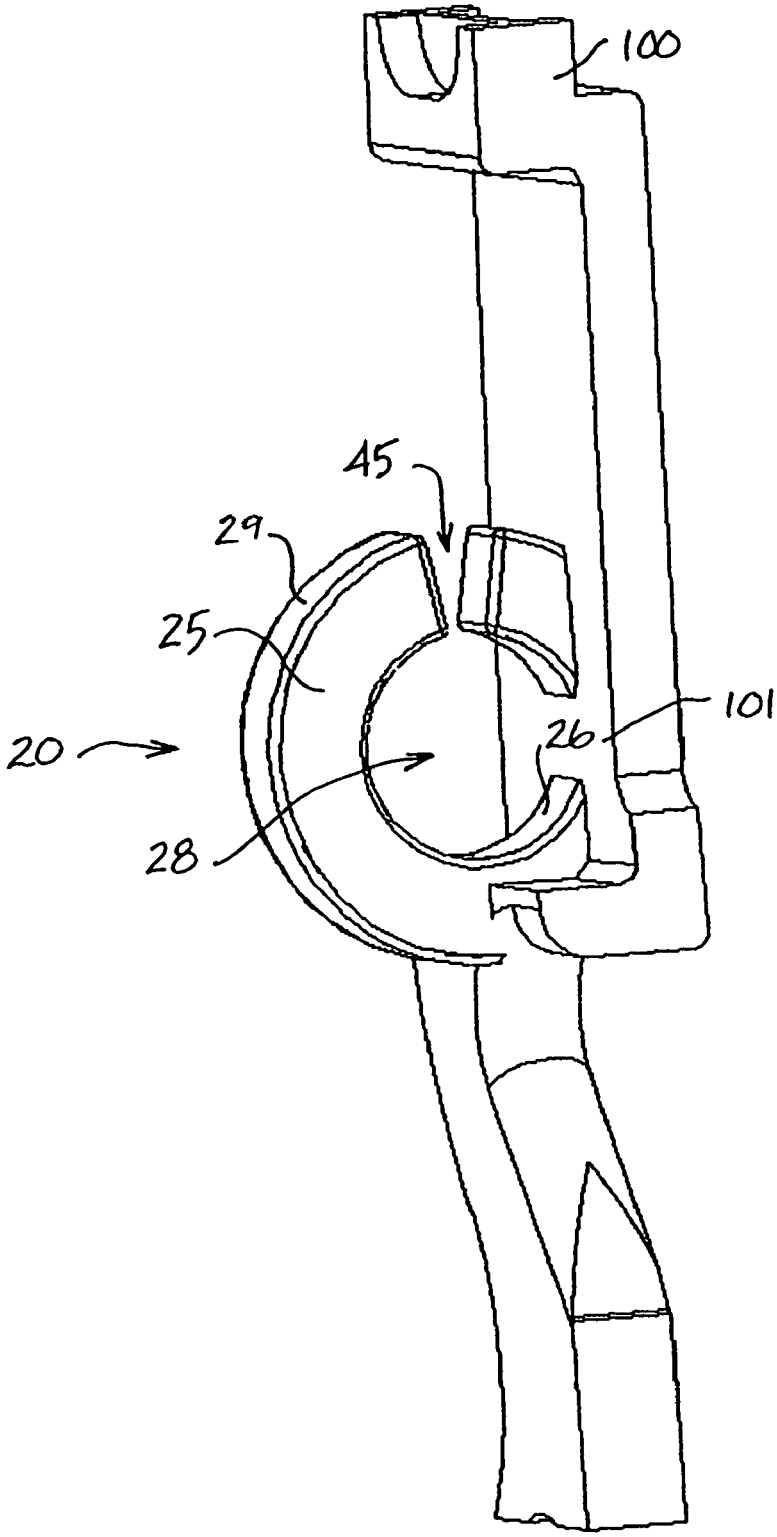
FIG. 11 is a partial front perspective view of a magnetic arrow rest integrated with an archery bow, according to one preferred embodiment of this invention.

As shown in FIG. 11, magnetic ring 25 can be integrated with the archery bow 100. By integrating magnetic ring 25 with the bow riser 101, for example, the need for attachment bracket 32 is eliminated, thus reducing the overall weight of arrow rest 20. Further, by integrating magnetic ring 25 with the archery bow 100, material can be removed from the archery bow 100 to further reduce the overall weight of the archery bow/arrow rest assembly.

Figure 2:
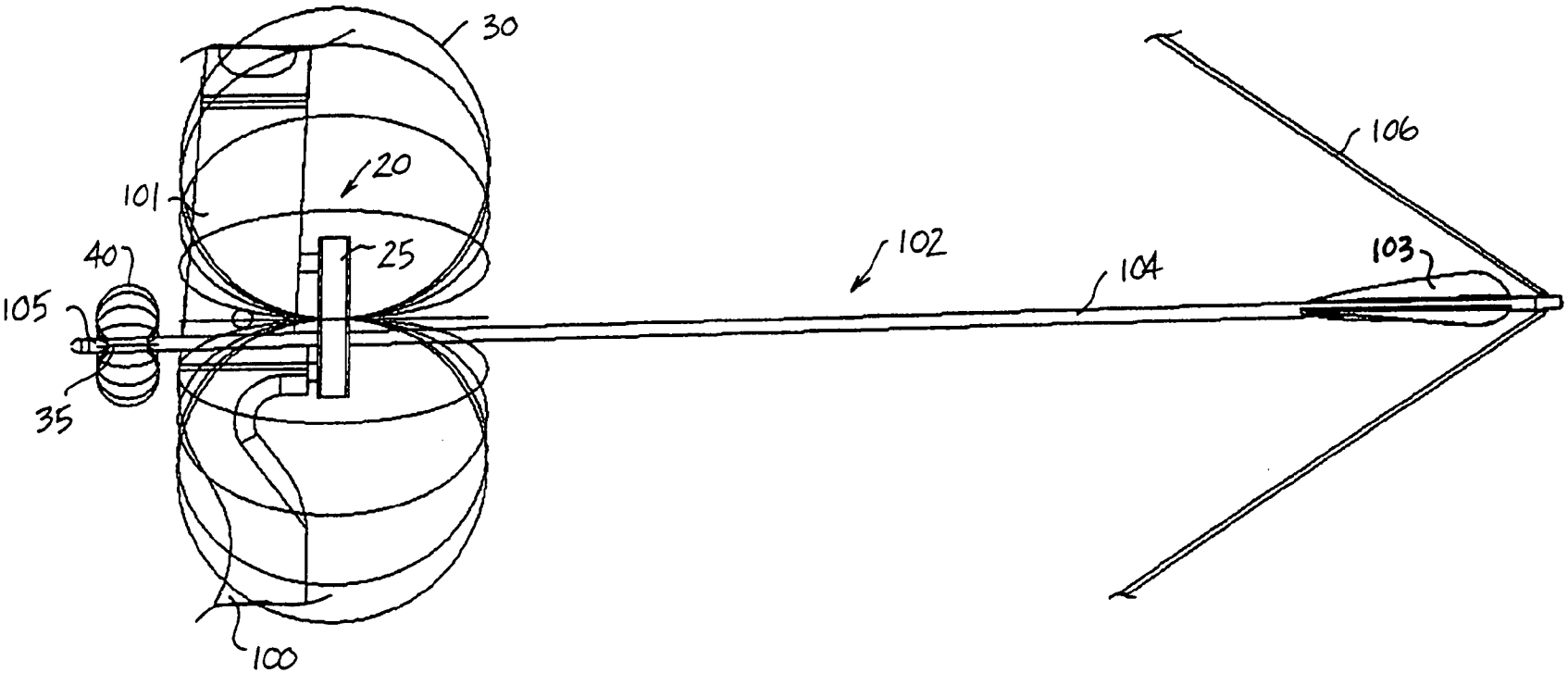
FIG. 2 is a side view of an archery arrow positioned in a partially drawn position within a magnetic arrow rest, according to one preferred embodiment of this invention.
Figure 12:
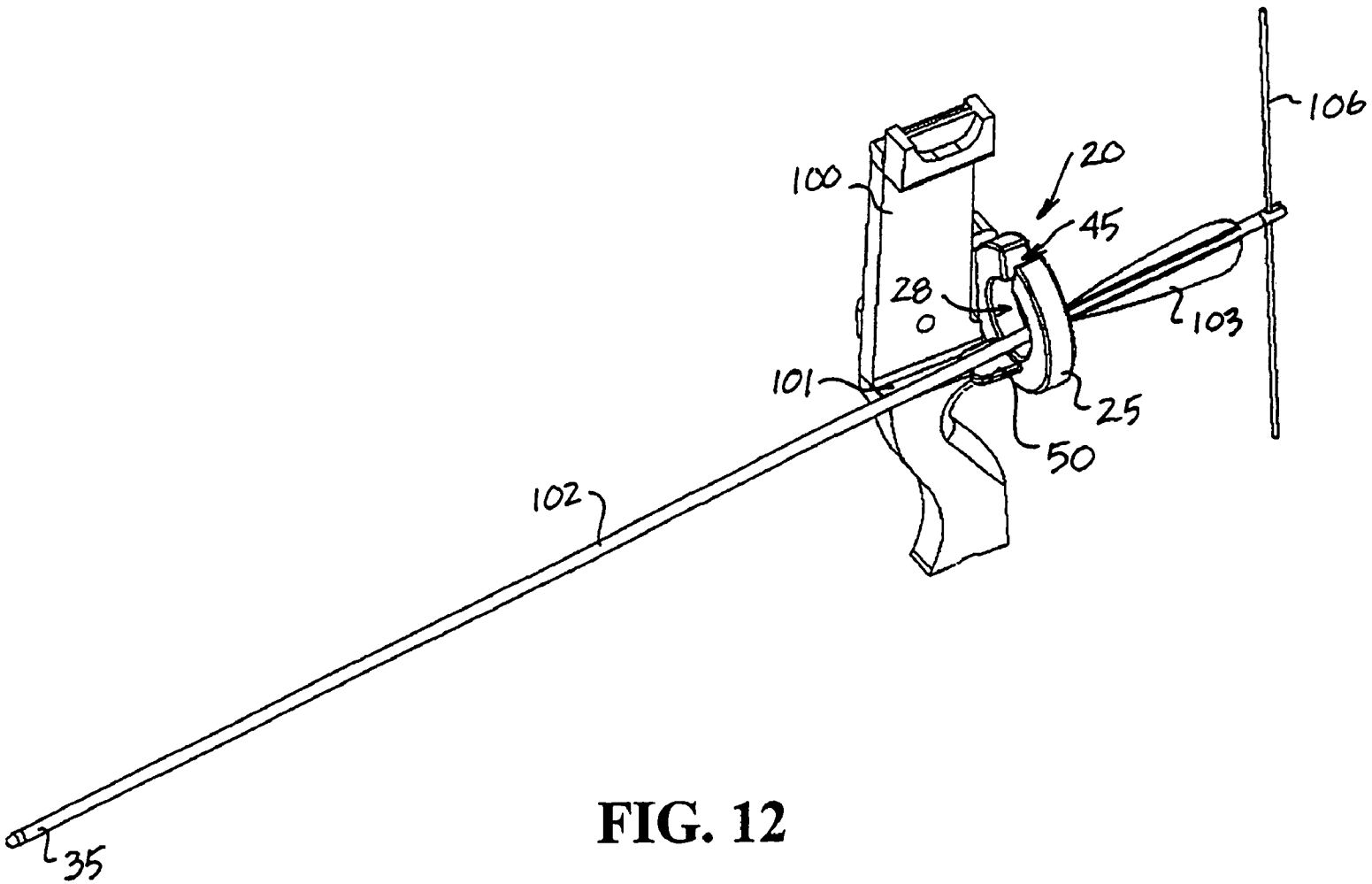
FIG. 12 is a perspective view of an archery arrow positioned in a rest or loading position within a magnetic arrow rest, with a damper in a biased position, according to one preferred embodiment of this invention.

In one preferred embodiment of this invention, arrow rest 20 further includes a dampening mechanism or component for preventing or minimizing an oscillation, such as a vertical oscillation of the arrow shaft 104 within arrow shaft passage 28 as a result of the magnetic interaction between first magnetic field 30 produced by magnetic ring 25 and second magnetic field 40 produced by second magnet 35, with the archery arrow in the drawn position. For example, in the rest or loading position as shown in FIGS. 1 and 12, the arrow shaft 104 rests on a shelf formed at the bow riser 101 frontal to magnetic ring 25. As the archery arrow 102 is drawn, first magnetic field 30 interacts with second magnetic field 40 to raise the arrow shaft 104 from the riser shelf, as shown in FIG. 2. With the archery arrow 104 in the drawn position as shown in FIG. 3, a portion of the archery arrow shaft 104 is suspended within arrow shaft passage 28 as a result of the magnetic interaction between first magnetic field 30 and second magnetic field 40. However, the rising action may cause vertical oscillation, for example, of the archery arrow 102. Because there is no or only minimal friction between the archery arrow 102 and arrow rest 20, the oscillation may not adequately stop or diminish prior to release of the archery arrow 102 from the archery bow 100. Thus, the dampening mechanism or component can be used to prevent or minimize oscillation or vibration of the arrow shaft 104 within arrow shaft passage 28. In contract, while using conventional arrow rests, the archer is typically required to move a finger, such as the index finger, from supporting the archery bow to touch or contact the archery arrow to dampen the oscillation or vibration. Not only is this difficult for many archers to do, it is also not recommended for safety reasons.

Figure 13:
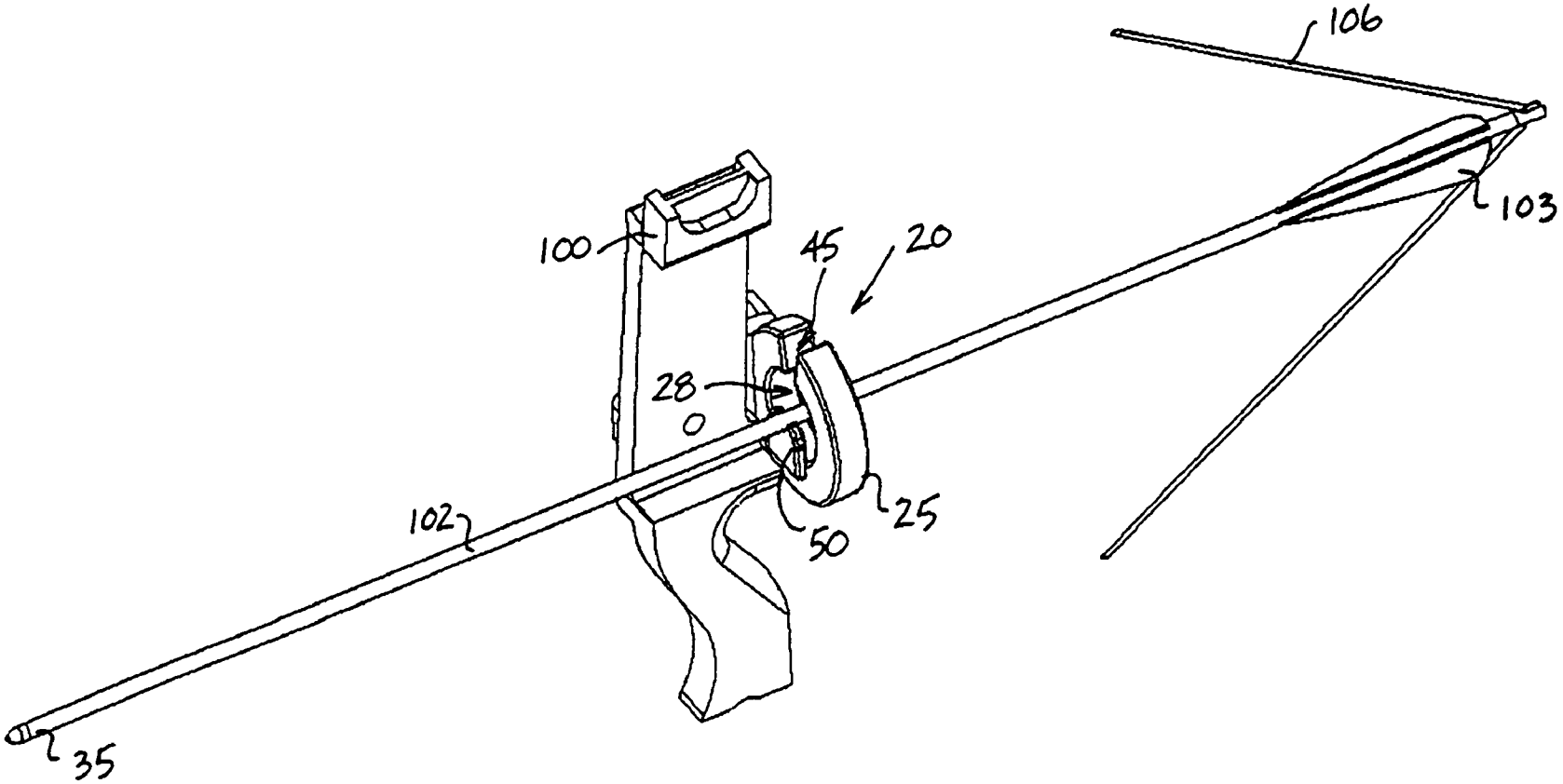
FIG. 13 is a perspective view of an archery arrow positioned in a partially drawn position within a magnetic arrow rest, with a damper in an extended position, according to one preferred embodiment of this invention.
Figure 14:
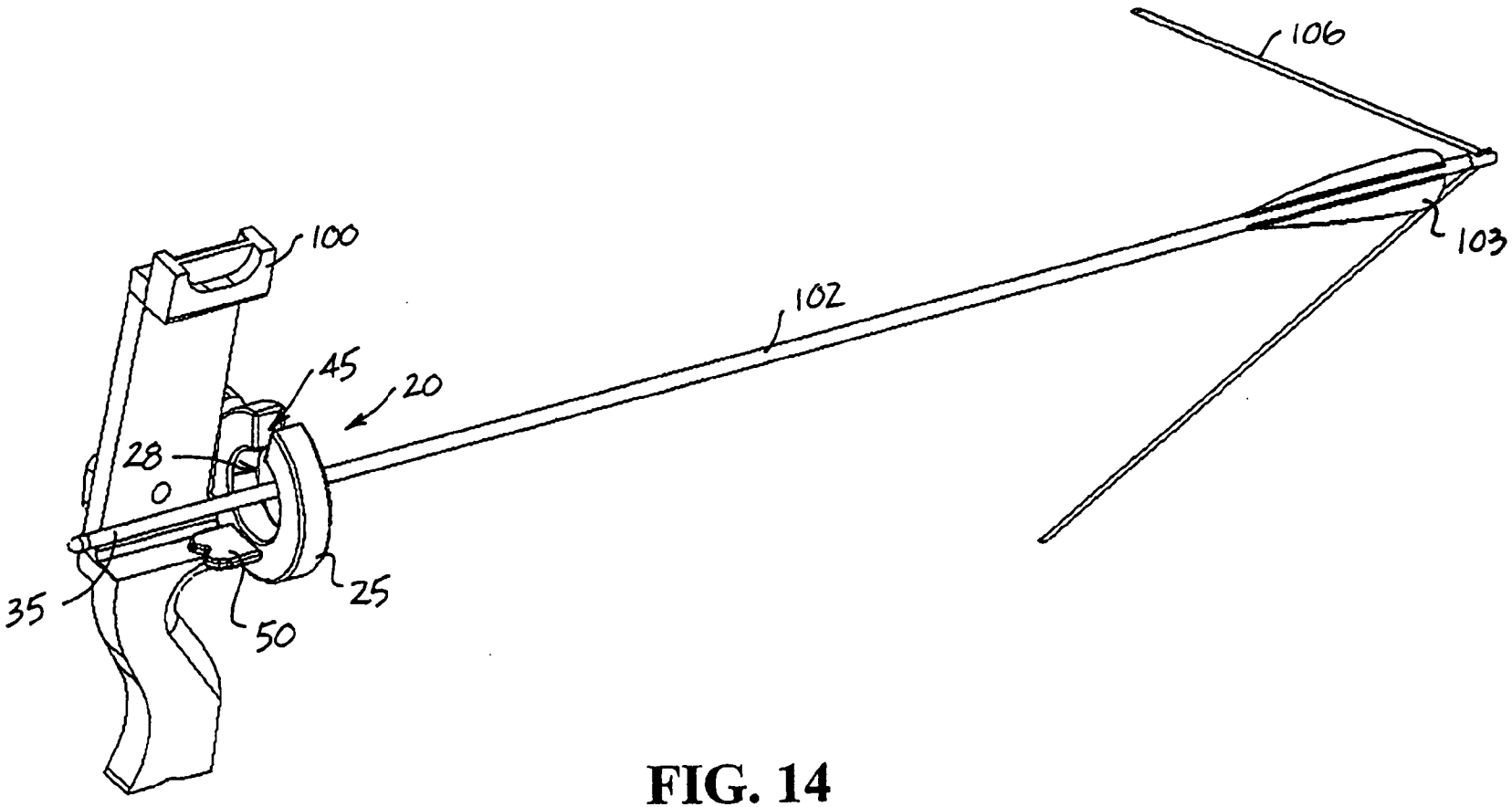
FIG. 14 is a perspective view of an archery arrow positioned in a final or drawn position within a magnetic arrow rest, with a damper in a biased position, according to one preferred embodiment of this invention.

In one preferred embodiment of this invention, arrow rest 20 includes a damper 50 pivotally connected with respect to arrow shaft passage 28 and movable between a biased position, as shown in FIG. 12, and an extended position, as shown in FIG. 13. Preferably, damper 50 is mounted to arrow rest 20 frontal to magnetic ring 25 and biased to lay against arrow rest 20 in a direction generally parallel to the intended path of the archery arrow 102, as shown in FIGS. 12 and 14. Damper 50 supports the arrow shaft 104 as the archery arrow 102 is nocked, and prevents or minimizes oscillation of the archery arrow 102 as the archery arrow is drawn. With the archery arrow 102 in the drawn position and with minimal archery arrow oscillation, a spring (not shown) biases damper 50 towards the biased position, as shown in FIG. 14.

Figure 15:
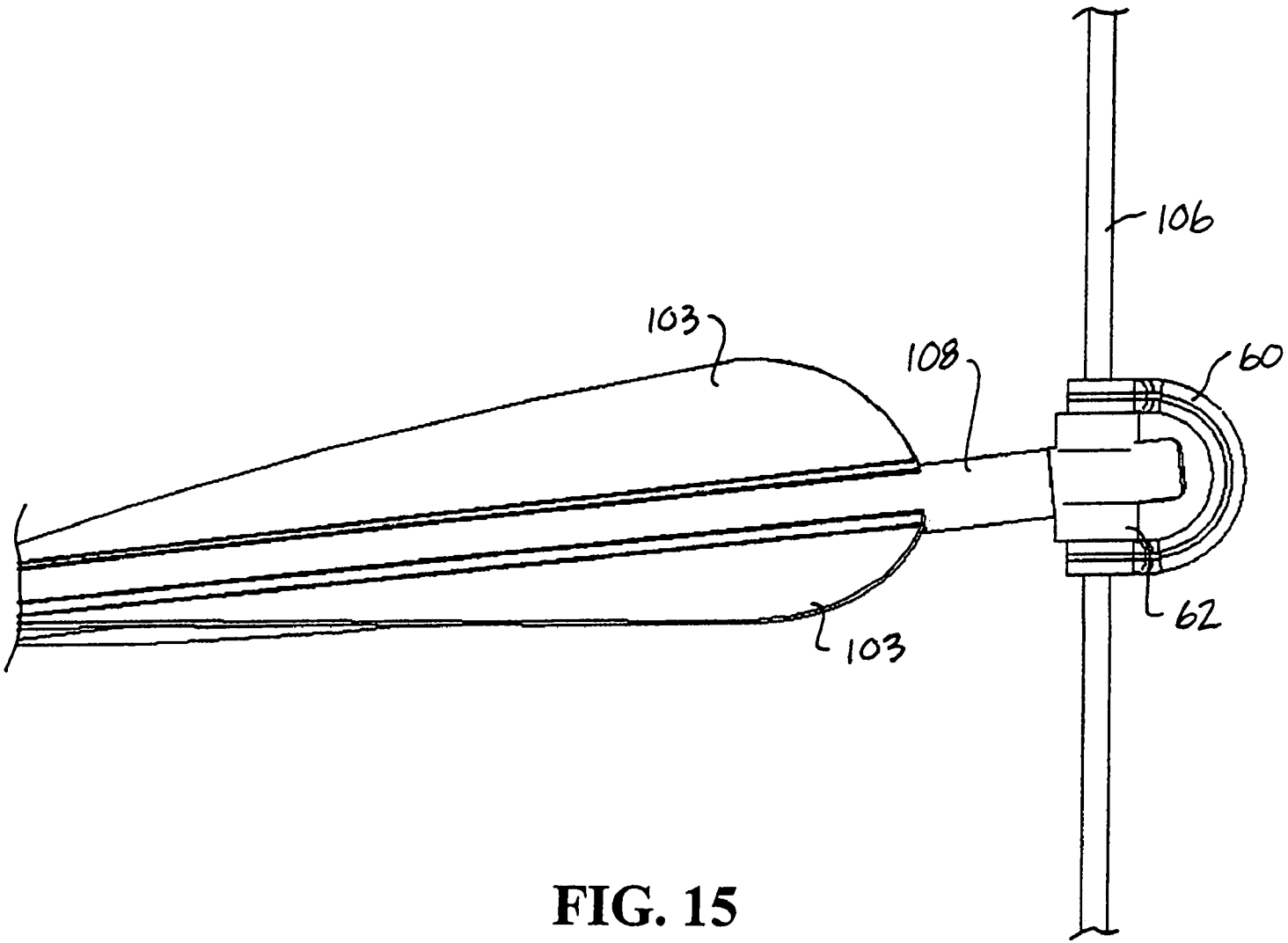
FIG. 15 is a side view of a nock portion of an archery arrow positioned in a rest or loading position within a dampening device attached to an archery bow string, according to one preferred embodiment of this invention.
Figure 16:
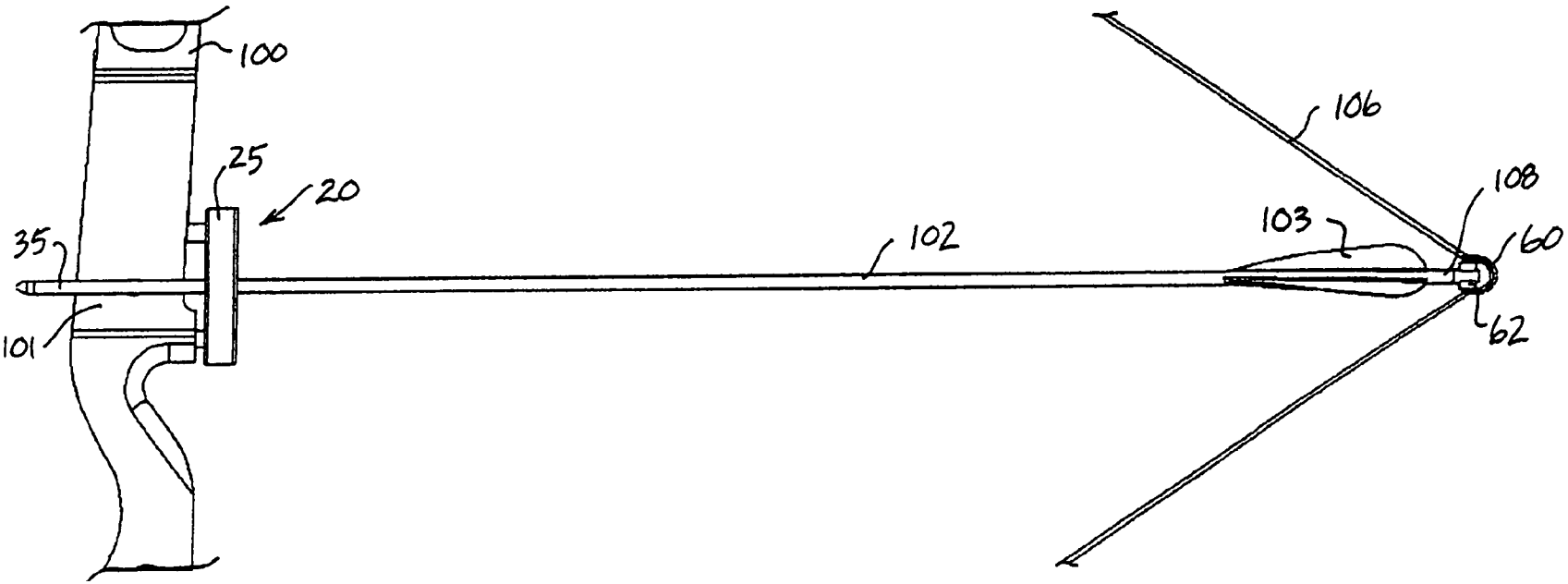
FIG. 16 is a side view of an archery arrow positioned in a final or drawn position within a magnetic arrow rest, with a nock portion of the archery arrow positioned within a dampening device attached to an archery bow string, according to one preferred embodiment of this invention.

In one preferred embodiment of this invention, the arrow rest assembly includes a dampening device 60 attachable to the bow string 106. As shown in FIGS. 15 and 16, dampening device 60 includes at least one pad 62, and preferably two opposing pads 62. Preferably, each pad 62 is made of a rubber or other suitable resilient material. The archer pinches or compresses opposing pads 62 against a nock portion 108 of the archery arrow 102 and against the bow string 106, to dampen, minimize or prevent archery arrow oscillation and/or vibration, as the archery arrow is moved to the drawn position, as shown in FIG. 16.

Figure 17:
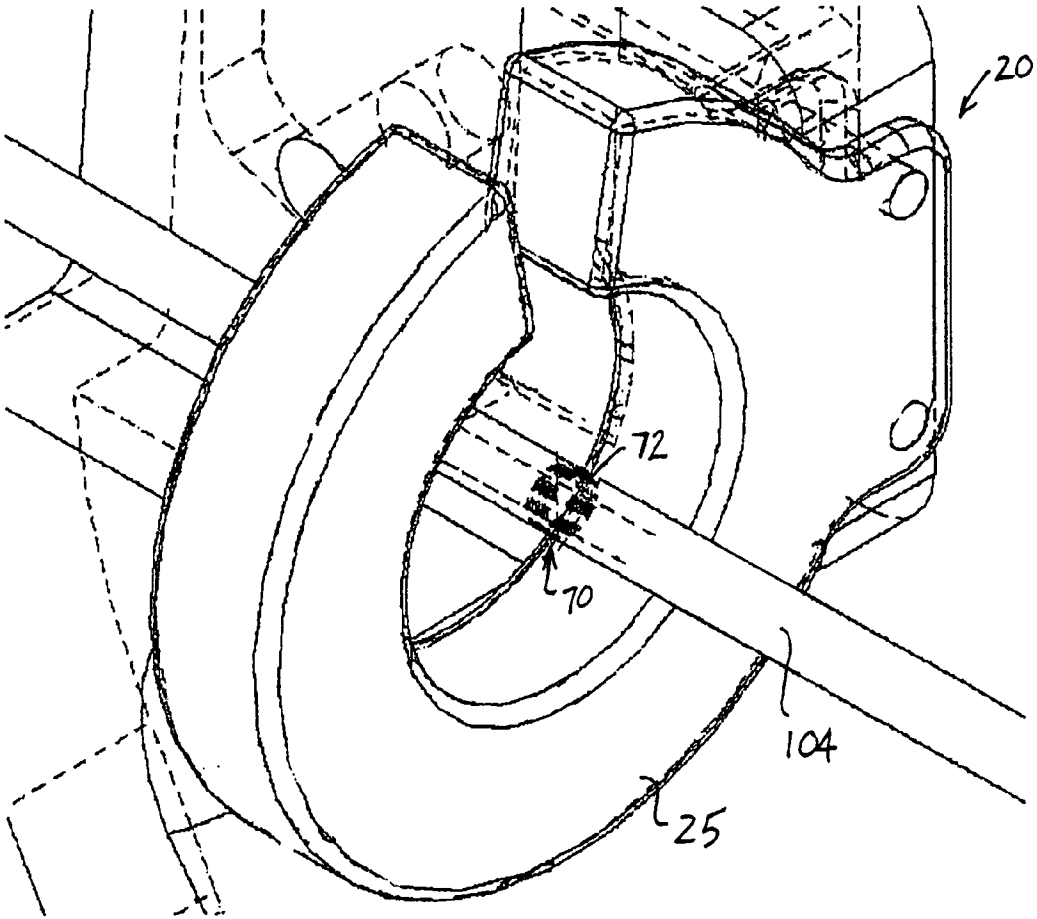
FIG. 17 is a perspective view of an arrow rest assembly including a magnetic dampening element comprising a plurality of conductive disks positioned with respect to an archery arrow, according to one preferred embodiment of this invention.
Figure 18:
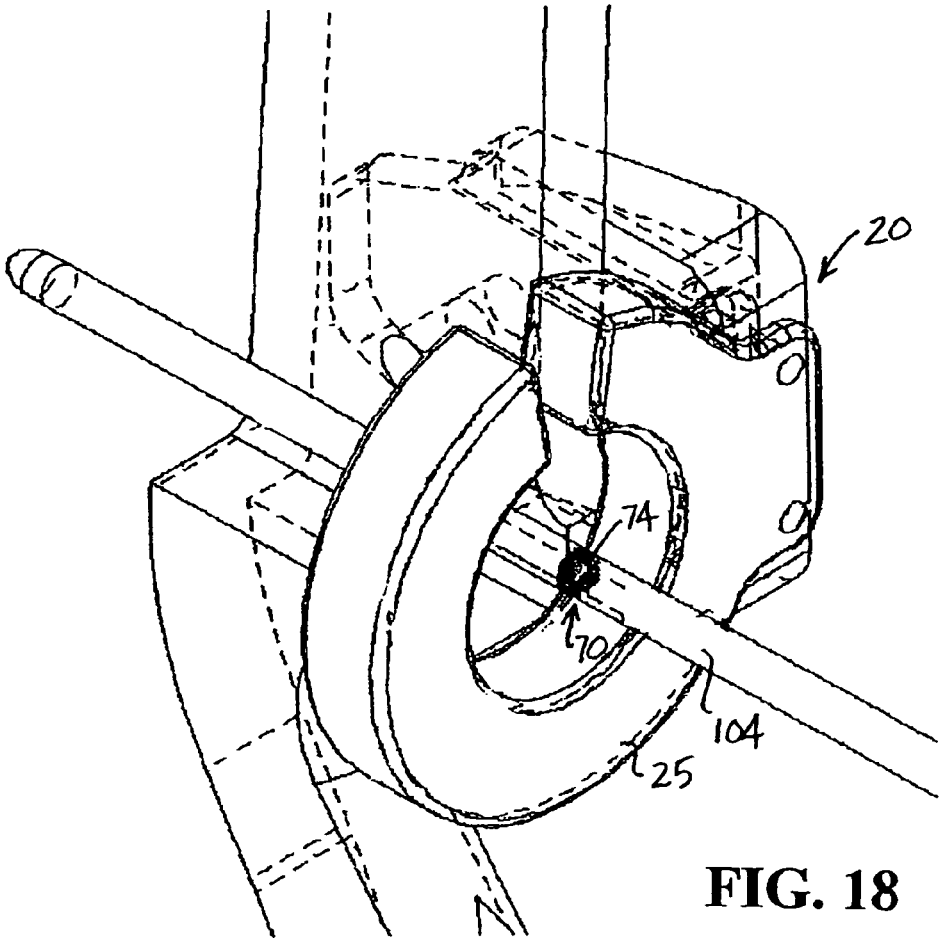
FIG. 18 is a perspective view of an arrow rest assembly including a magnetic dampening element comprising a plurality of conductive coils positioned with respect to an archery arrow, according to one preferred embodiment of this invention.
Figure 19:
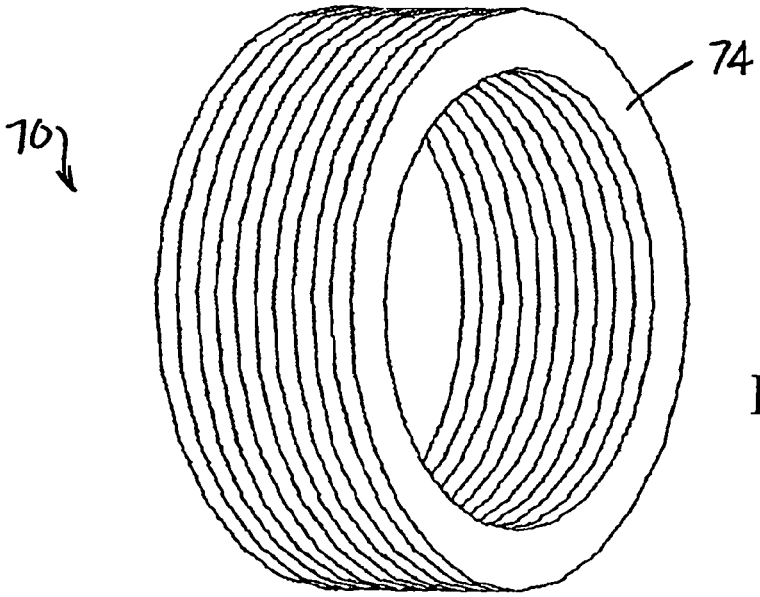
FIG. 19 is a perspective view of a magnetic dampening element comprising a plurality of conductive coils, according to one preferred embodiment of this invention.

In one preferred embodiment of this invention, the arrow rest assembly includes a magnetic dampening element 70 including at least one and preferably a plurality of conductive plates or disks 72, as shown in FIG. 17, and/or at least one and preferably a plurality of conductive coils 74, as shown in FIGS. 18 and 19. Conductive disks 72 and/or conductive coils 74 are preferably positioned with respect to the arrow shaft 104, for example about or within the arrow shaft and generally perpendicular to the first magnetic field lines to generate a sufficient electrical current in conductive disks 72 and/or coils 74. The resulting magnetic field generated by disks 72 and/or coils 74 interacts with the first magnetic field 30 to dampen the archery arrow oscillation and/or vibration. Preferably, the generated magnetic field has a polarity that directly opposes the polarity of first magnetic field 30. The intensity of the generated magnetic field is proportional to the velocity in disks 72 and/or coils 74, and reduces the amplitude of the archery arrow oscillations. Conducting disks 72 and/or coils 74 are preferably placed within the arrow shaft at a location wherein the magnetic field strength is the greatest to provide the most effective dampening.

Figure 20:
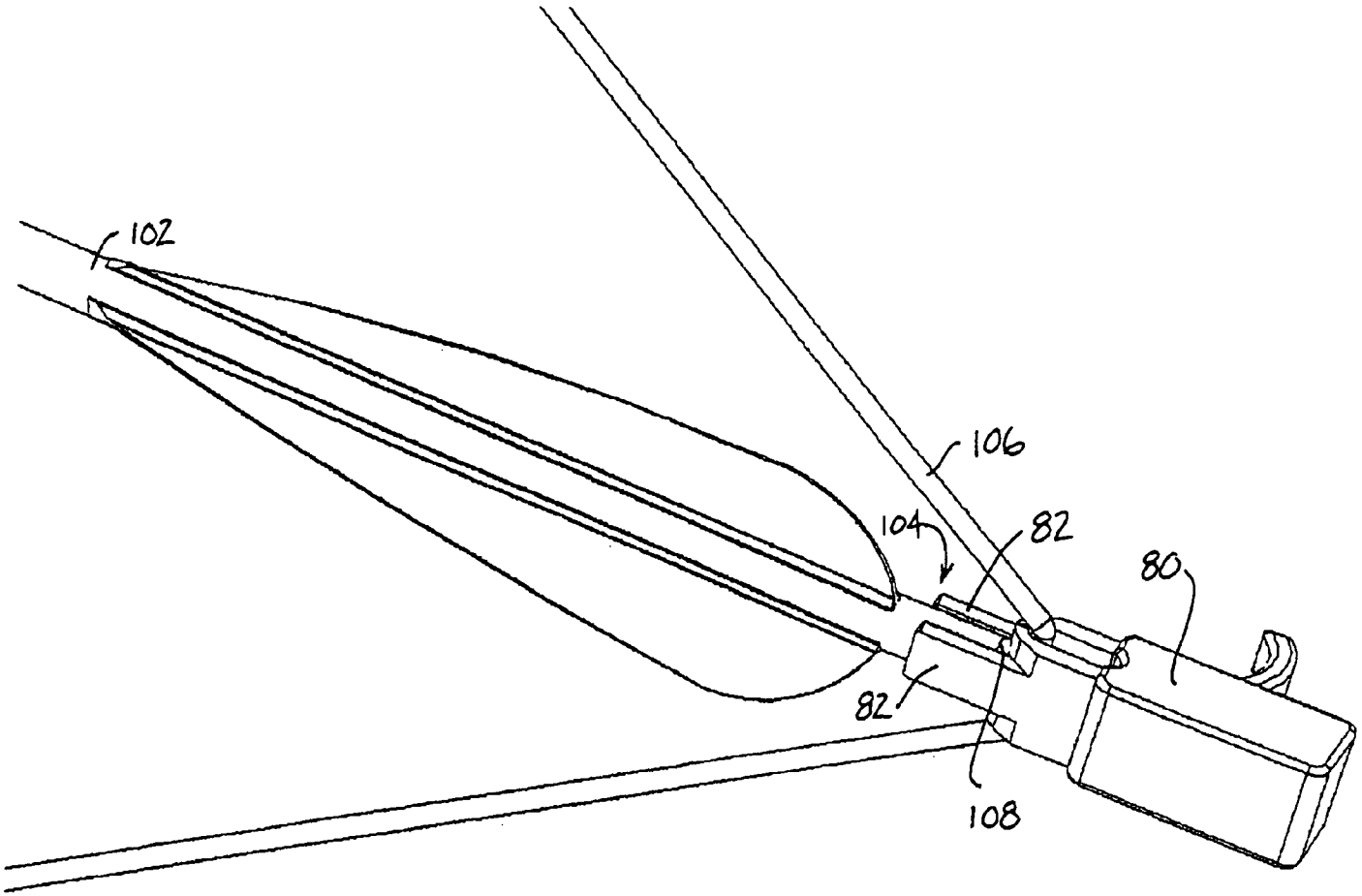
FIG. 20 is a perspective view of a nock portion of an archery arrow positioned in a drawn position within a release aid mounted with respect to a bow string, according to one preferred embodiment of this invention.
Figure 21:
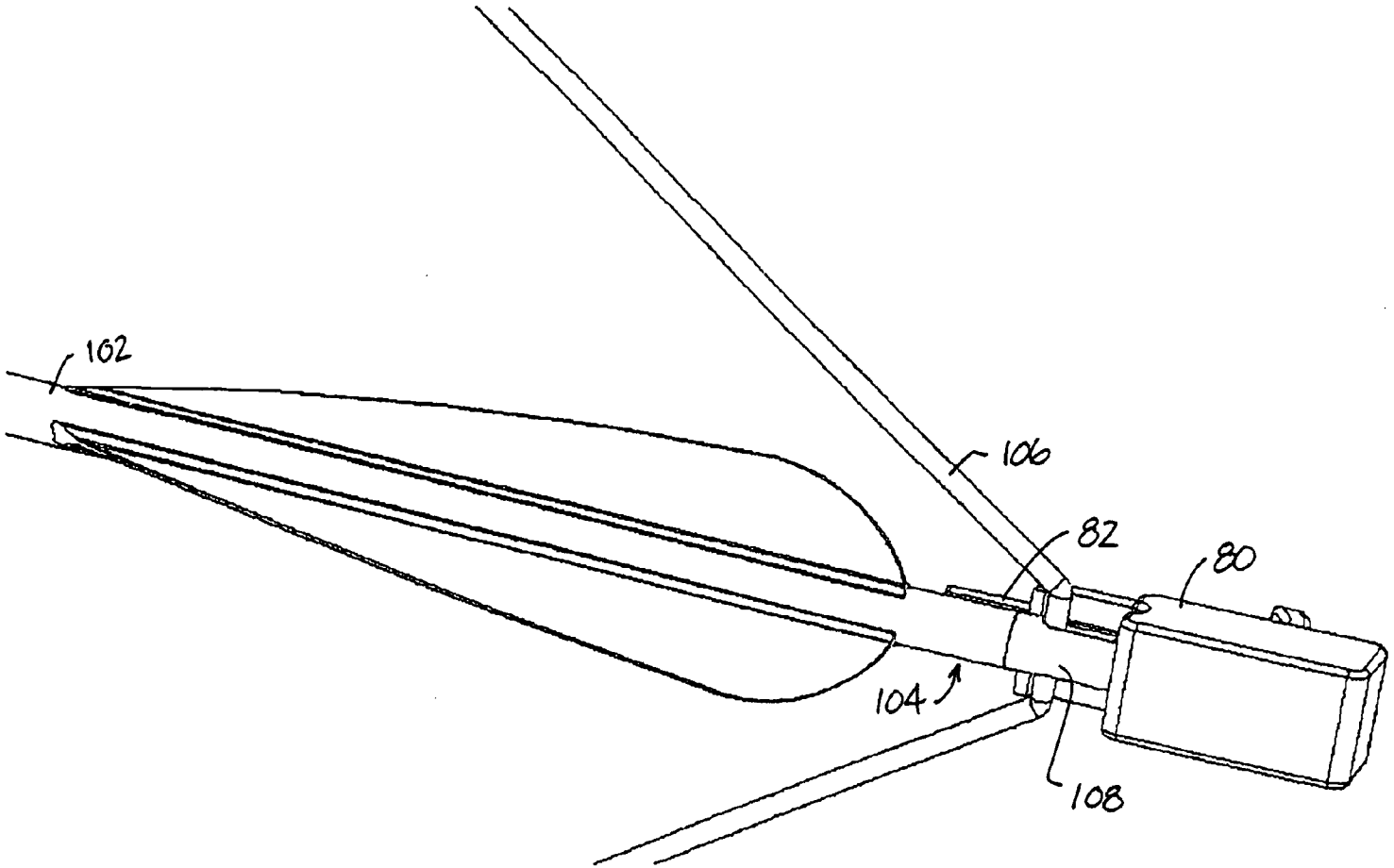
FIG. 21 is a perspective view of a nock portion of an archery arrow positioned in a drawn position within a release aid mounted with respect to a bow string and with one release aid grip removed, according to one preferred embodiment of this invention.
Figure 22:
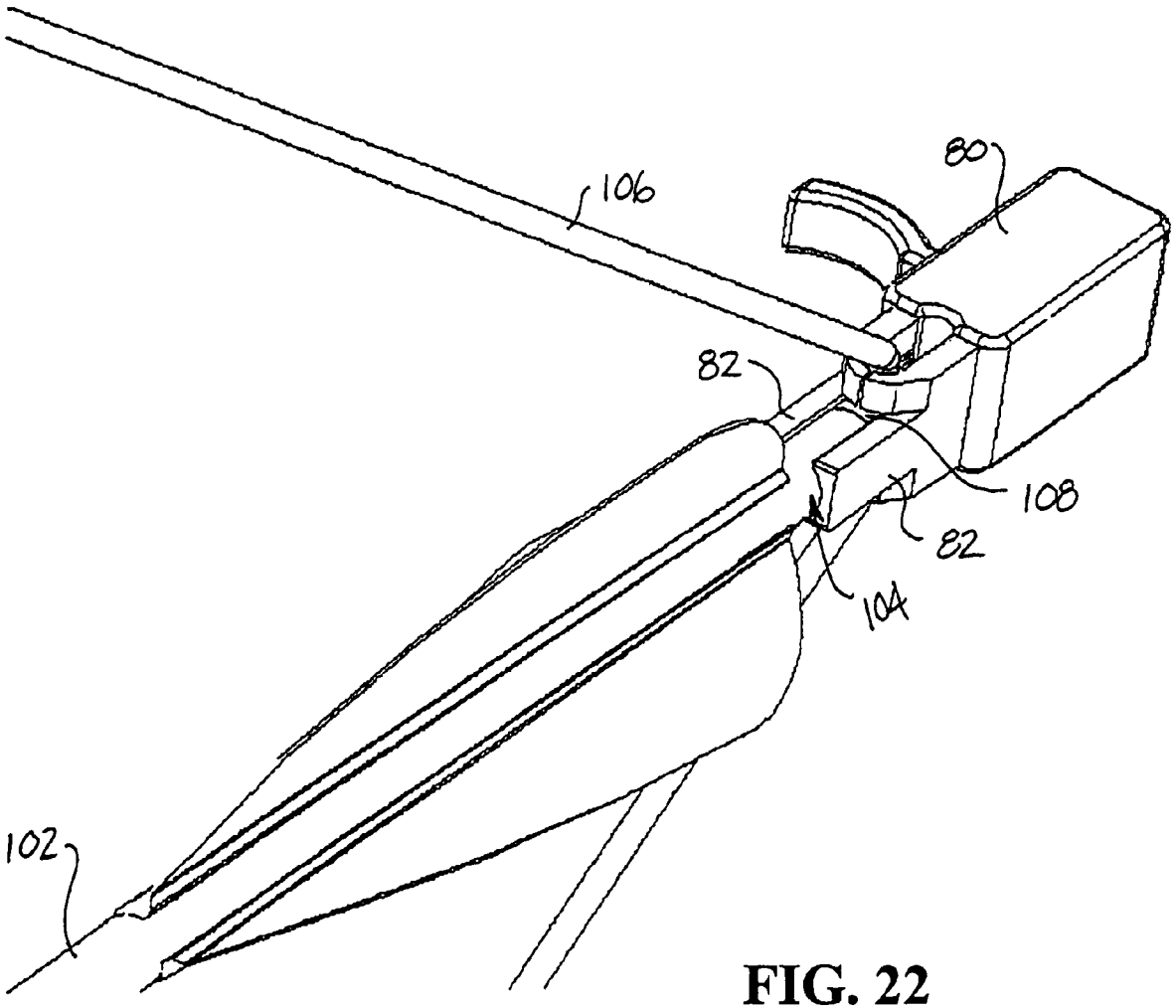
FIG. 22 is a perspective view of a nock portion of an archery arrow positioned in a drawn position within a release aid mounted with respect to a bow string, according to one preferred embodiment of this invention.

In one preferred embodiment of this invention, the arrow rest assembly includes a release aid 80 removably mountable with respect to the bow string 106. Release aid 80 includes opposing conformable grips 82, as shown in FIGS. 20–22. Preferably, but not necessarily, conformable grips 82 are made of an elastomeric material or a suitable resilient material known in the art. Conformable grips 82 hold the archery arrow nock portion 108 and/or an adjacent portion of the arrow shaft 104 to support the archery arrow 102 in a vertical plane of the archery bow. Release aid 80 minimizes the force required by the magnetic interaction between magnetic ring 25 and second magnet 35 to suspend a portion of the arrow shaft 104 within arrow shaft passage 28, in the drawn position. Further, release aid 80 prevents or minimizes the oscillation of the archery arrow by minimizing vertical lift of the arrow shaft within arrow shaft passage 28, and by snubbing the vibration by gripping the nock portion 108. Because the required force to lift the archery arrow portion positioned within arrow rest 20 is reduced, the size, and therefore the mass, of second magnet 35 can be significantly reduced.

Thus, the present invention provides an arrow rest and an arrow rest assembly that includes a magnetic ring mounted with respect to an archery bow. The magnetic ring includes an inner surface forming or defining an arrow shaft passage and a generally opposing outer surface. The magnetic ring can be mounted to an attachment bracket secured to the archery bow and with respect to a riser shelf of the archery bow or can be integrated with the archery bow. The magnetic ring produces a first magnetic field about the arrow shaft passage. The magnetic ring forms or includes an opening extending between the inner surface and the outer surface, which communicates with the archery shaft passage for receiving a shaft of an archery arrow. The arrow shaft is passable through the opening and positionable within the arrow shaft passage. The archery arrow is movable with respect to the arrow rest and the archery bow through the arrow shaft passage between a loading position and a drawn position.

The arrow rest assembly includes a second magnet that is mountable at a tip portion of the archery arrow. Preferably, the second magnet is a magnetic insert that can be inserted within the arrow shaft at the archery arrow tip portion. The second magnet produces a second magnetic field. With the archery arrow in a drawn position, the first magnetic field interacts with the second magnetic field to suspend a portion of the arrow shaft within the arrow shaft passage. Preferably, the suspended portion of the arrow shaft is centered within the first magnetic field.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In an arrow rest assembly comprising a magnetic ring mounted with respect to an archery bow, the magnetic ring including an inner surface defining an arrow shaft passage and an outer surface, the magnetic ring producing a first magnetic field about the arrow shaft passage; and a second magnet mountable at a tip portion of an archery arrow, the archery arrow movable through the arrow shaft passage between a loading position and a drawn position, the second magnet producing a second magnetic field, and in the drawn position the first magnetic field interacting with the second magnetic field to suspend a portion of the arrow shaft within the arrow shaft passage, the improvement comprising:

the magnetic ring forming an opening between the inner surface and the outer surface for receiving a shaft of the archery arrow, the arrow shaft positionable within the arrow shaft passage, a magnetic dampening element, the magnetic dampening element including at least one conductive disk positioned with respect to the arrow shaft and generally perpendicular to the first magnetic field, the at least one conductive disk generating a magnetic field interacting with the first magnetic field.

2. The arrow rest assembly of claim 1 further comprising a damper pivotally connected with respect to the arrow shaft passage and movable between a biased position and an extended position for supporting the arrow shaft as the archery arrow is moved with respect to the arrow rest to the drawn position.

3. The arrow rest assembly of claim 1 further comprising a dampening device attachable about a bow string of the archery bow and including at least one pad compressing a nock portion of the archery arrow against the bow string.

4. The arrow rest assembly of claim 1 wherein the magnetic ring is integrated with the archery bow.

5. The arrow rest assembly of claim 1 further comprising a release aid removably mountable with respect to a bow string of the archery bow, the release aid including opposing conformable grips holding a nock portion of the arrow shaft to support the archery arrow in a vertical plane of the archery bow, in the drawn position.

6. The arrow rest assembly of claim 1 wherein a polarity of the magnetic field generated by the at least one conductive disk opposes a polarity of the first magnetic field.

7. The arrow rest assembly of claim 1, wherein the magnetic dampening element including at least one conductive coil positioned with respect to the arrow shaft and generally perpendicular to the first magnetic field, the at least one conductive coil generating a magnetic field interacting with the first magnetic field.

8. The arrow rest assembly of claim 7 wherein a polarity of the magnetic field generated by the at least one conductive coil opposes a polarity of the first magnetic field.

* * * * *